US009707582B2

(12) United States Patent
Brugger

(10) Patent No.: US 9,707,582 B2
(45) Date of Patent: Jul. 18, 2017

(54) SPRAY DISPENSER FOR PLURAL COMPONENTS

(71) Applicant: Gerhard Brugger, Pflach (AT)

(72) Inventor: Gerhard Brugger, Pflach (AT)

( * ) Notice: Subject to any disclaimer, the term of this patent is extended or adjusted under 35 U.S.C. 154(b) by 0 days.

(21) Appl. No.: 13/892,146

(22) Filed: May 10, 2013

(65) Prior Publication Data

US 2014/0061239 A1 Mar. 6, 2014

(30) Foreign Application Priority Data

May 12, 2012 (DE) ..... 20 2012 004 644 U

(51) Int. Cl.

| | |
|---|---|
| ***B67D 7/70*** | (2010.01) |
| ***B05B 11/00*** | (2006.01) |
| ***B65D 81/32*** | (2006.01) |
| ***B65D 83/00*** | (2006.01) |

(52) U.S. Cl.

CPC ..... *B05B 11/3085* (2013.01); *B05B 11/3083* (2013.01); *B05B 11/3084* (2013.01); *B65D 81/32* (2013.01); *B65D 83/00* (2013.01)

(58) Field of Classification Search

CPC ..... B05B 11/3083–11/3085; B65D 81/32
USPC ..... 222/135, 144.5, 321.1, 134, 137, 309, 222/267, 282, 283, 287, 144; 251/353
See application file for complete search history.

(56) References Cited

U.S. PATENT DOCUMENTS

| | | | | |
|---|---|---|---|---|
| 3,020,938 | A * | 2/1962 | Ballin | 141/24 |
| 3,848,778 | A * | 11/1974 | Meshberg | 222/402.11 |
| 4,006,841 | A * | 2/1977 | Alticosalian | 222/42 |
| 5,411,176 | A * | 5/1995 | Favre | 222/94 |
| 5,609,299 | A * | 3/1997 | Foster et al. | 239/304 |
| 5,634,571 | A * | 6/1997 | Cataneo et al. | 222/80 |
| 5,833,121 | A * | 11/1998 | Gueret | 222/144.5 |
| 5,848,732 | A * | 12/1998 | Brugger | 222/137 |
| 5,971,230 | A * | 10/1999 | Tanaka | 222/402.11 |
| 6,299,023 | B1 | 10/2001 | Arnone | |
| 6,443,331 | B1 * | 9/2002 | DeJonge | 222/153.13 |
| 6,464,107 | B1 * | 10/2002 | Brugger | 222/134 |
| 7,195,135 | B1 * | 3/2007 | Garcia et al. | 222/137 |
| 7,290,681 | B2 * | 11/2007 | Decottignies et al. | 222/135 |
| 7,757,968 | B2 * | 7/2010 | Bistolfi | 239/333 |
| 7,854,350 | B2 * | 12/2010 | Lasserre et al. | 222/137 |
| 8,814,002 | B2 * | 8/2014 | Pires et al. | 222/135 |
| 2001/0025860 | A1 * | 10/2001 | Auer | 222/137 |
| 2003/0146242 | A1 * | 8/2003 | Peterson | 222/137 |
| 2004/0129727 | A1 * | 7/2004 | Foster et al. | 222/137 |

(Continued)

FOREIGN PATENT DOCUMENTS

| | | | |
|---|---|---|---|
| CH | 687 698 | A5 | 1/1997 |
| DE | 3911089 | A1 | 10/1990 |

(Continued)

*Primary Examiner* — Patrick M Buechner
*Assistant Examiner* — Michael J Melaragno
(74) *Attorney, Agent, or Firm* — Price Heneveld LLP

(57) ABSTRACT

For creating a simplified and cost effective spray dispenser for plural components, in particular for an adjustable dispenser having a compact design, wherein outlet openings are provided at a respective supply channel each having a pump unit for each component, it is proposed to form the respective supply channel (4*a*, 4*b*) as straight element at manufacturing (FIG. 8), especially by injection molding and then bend it into a curved form on assembly (FIG. 9) in the spray dispenser (1).

5 Claims, 3 Drawing Sheets

(56) References Cited

U.S. PATENT DOCUMENTS

| | | | | |
|---|---|---|---|---|
| 2004/0238567 | A1* | 12/2004 | Bloc | 222/135 |
| 2004/0251274 | A1* | 12/2004 | Ponton | 222/134 |
| 2005/0150905 | A1* | 7/2005 | van der Heijden | 222/135 |
| 2006/0054633 | A1* | 3/2006 | Brugger | 222/94 |
| 2007/0289997 | A1* | 12/2007 | Lewis et al. | 222/137 |
| 2007/0289999 | A1* | 12/2007 | Rossignol | 222/137 |
| 2008/0237261 | A1* | 10/2008 | van der Heijden | 222/135 |
| 2010/0044394 | A1* | 2/2010 | Milian et al. | 222/135 |
| 2010/0294809 | A1* | 11/2010 | Baier et al. | 222/383.1 |
| 2012/0031925 | A1* | 2/2012 | Greenberg | 222/135 |
| 2012/0241475 | A1* | 9/2012 | Dennis | 222/137 |
| 2012/0279990 | A1* | 11/2012 | Werner et al. | 222/132 |
| 2012/0280065 | A1 | 11/2012 | Foster et al. | |
| 2012/0298694 | A1* | 11/2012 | Holzmann | 222/135 |
| 2013/0119088 | A1* | 5/2013 | Hanai et al. | 222/135 |
| 2013/0299514 | A1* | 11/2013 | Holzmann | 222/134 |
| 2014/0144939 | A1* | 5/2014 | Bertin et al. | 222/135 |

FOREIGN PATENT DOCUMENTS

| | | | |
|---|---|---|---|
| DE | 94 11 522 | U1 | 11/1995 |
| DE | 694 21 187 | T2 | 2/2000 |
| DE | 10 2006 029 345 | U1 | 12/2007 |
| DE | 602 24 556 | T2 | 1/2009 |
| DE | 10 2008 001 312 | A1 | 10/2009 |
| DE | 20 2009 014 316 | U1 | 12/2010 |
| FR | 2 796 925 | A1 | 2/2001 |
| WO | WO-95/05998 | A1 | 3/1995 |
| WO | WO-03/041870 | A1 | 5/2003 |

* cited by examiner

SPRAY DISPENSER FOR PLURAL COMPONENTS

The invention relates to a spray dispenser for plural components, in particular for an adjustable dispenser, according to the features of the preamble of claim 1.

Spray dispensers are often used for cosmetics, such as perfumes to which a care component is added, wherein the outlet openings for the two (or more) components are close together, so that the spray cones overlap, thus mixing the product on application f. i. to the skin. A disadvantage is that the supply ducts are relatively complicated to produce with its two (or more) subtle channels. Further, the outlet openings should be aligned as parallel as possible to allow a high degree of overlap of the spray cones for mixing. However, the pump units are symmetrically arranged and spaced a few centimeters, such that for a parallel alignment of the outlet openings, the feed channels must be bent. This complicates the production in addition, as the fine passages are not very precisely shaped and the molded part is hard to demold, unless particularly complicated molds are used.

Thus, the invention is directed to a spray dispenser for multiple components, avoiding the mentioned disadvantages, in particular to create a simple, cost-effective and compact design.

This object is achieved by means of a spray dispenser having the features of claim 1. Advantageous embodiments are the subject of dependent claims.

The proposed design of the supply channels offers a precise formation of the fine passages of the respective feed channels on manufacturing by injection molding or a similar production technology. Further, easy demolding (out of the mold) is achieved, even with a simple tool structure. In addition, a close arrangement of the outlets and their parallel orientation is possible, which leads not only to a compact design, but also a good overlap of the spray cones and thus mixing results. The assembly of the initially straight feed channel to the bent position can be done very simple, in particular with a notch and an arched bracket.

Preferably, the outlet openings are disposed on slides or masks which are produced together with the respective pump head and the adjoining components and in one piece as injection-molded part, so that manufacturing advantages coincide with inexpensive manufacture.

Further, a radial projection can be provided at each pump head, which in turn is preferably manufactured as an integral molded part. This respective projection is arranged below an adjuster part to press on the corresponding pump unit when operating a push button. This can be done simultaneously so that a mixing ratio of two components is 1:1. The operation can also be effected by different height positioning of the protrusion and/or of the adjustment to a time lag, so that different mixing conditions result, as described in DE 20 2009 014 316. The adjuster part is preferably disposed between the pumping units, so that a particularly compact design of the spray dispenser is achieved. This is supported by the (nearly) flush arrangement of the adjuster part in the actuating button.

An embodiment of the spray dispenser is described by reference to the drawings, showing:

Figure 8:
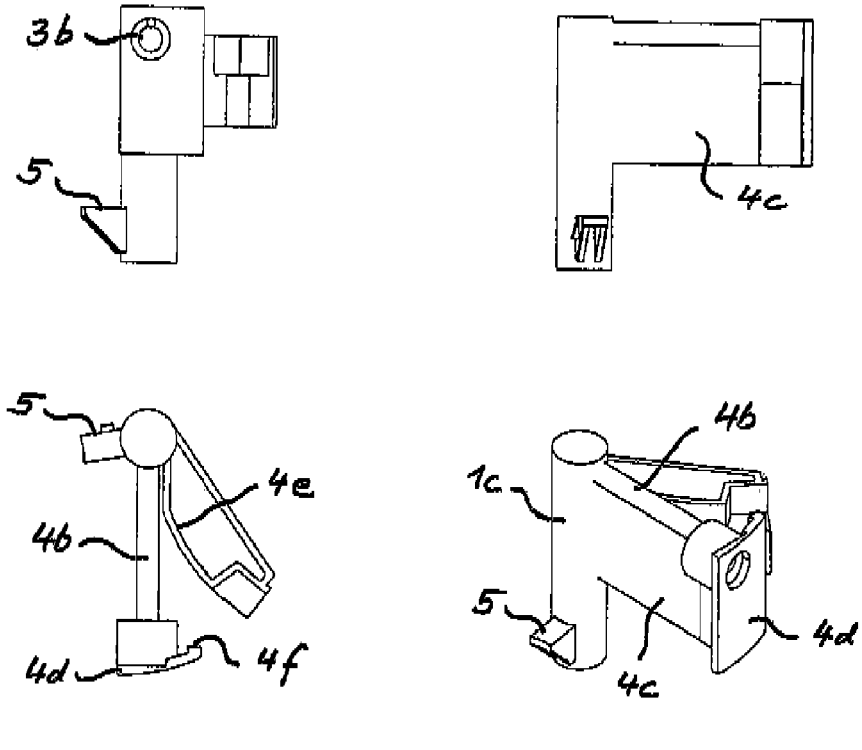

FIG. 8 four views of a supply channel in straight manufacturing state, and

Figure 9:
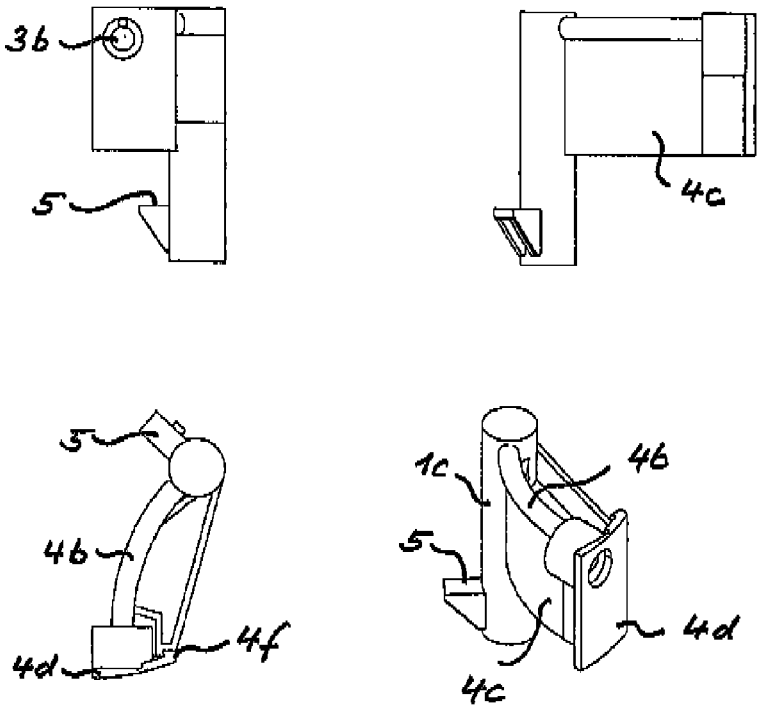

FIG. 9 four views of the supply channel in curved mounting condition.

Figure 1:
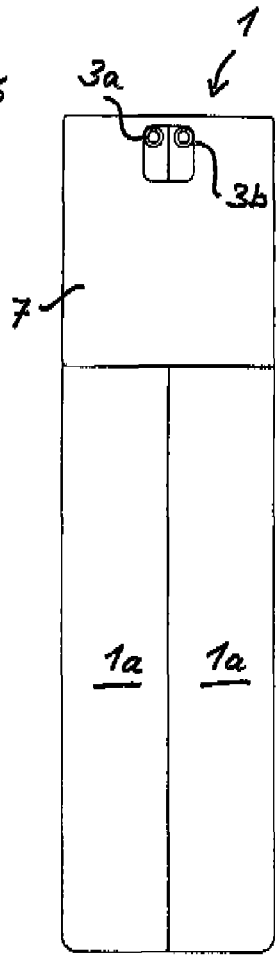
FIG. 1 is a front view of a spray dispenser.

FIG. 1 shows a spray dispenser 1 in front view as used for applying two-component products, for example cosmetic products consisting of two or more components. These components are extracted from cartridges 1*a*, only shown schematically, and are pumped by a respective pump unit 1*b*, wherein the two components pass through separate feed ducts or supply channels 4*a* and 4*b* (cf. FIG. 4) to outlet openings 3*a* and 3*b*. These are arranged adjacent to each other and preferably oriented in parallel to one another in order to achieve an overlap of the spray cones, when an actuator, here a sleeve-shaped press button 7 is pressed. The actuating stroke of about 1 cm can be derived from a window around the outlet openings 3*a* and 3*a* in FIG. 1.

Figure 3:
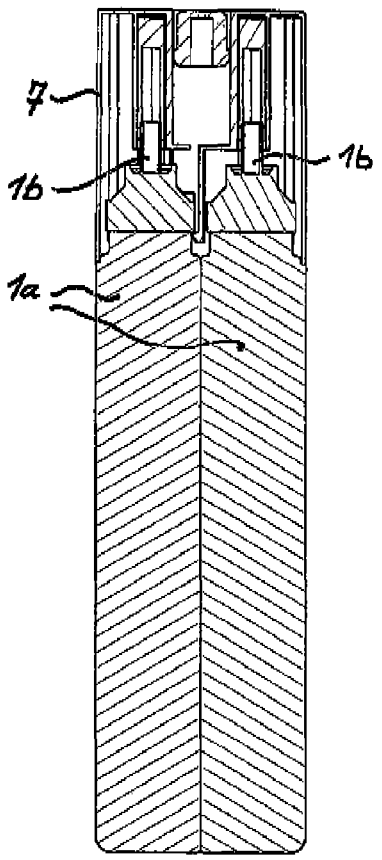
FIG. 3 is a sectional view taken along the section line A-A in FIG. 2.
Figure 2:
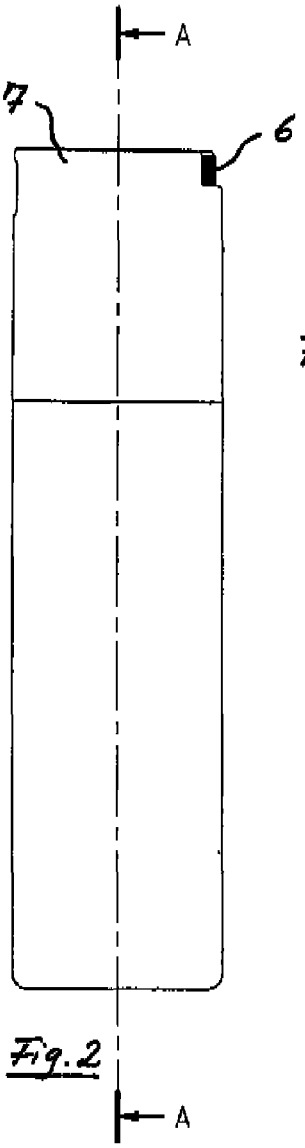
FIG. 2 is a side view of the spray dispenser.
Figure 4:
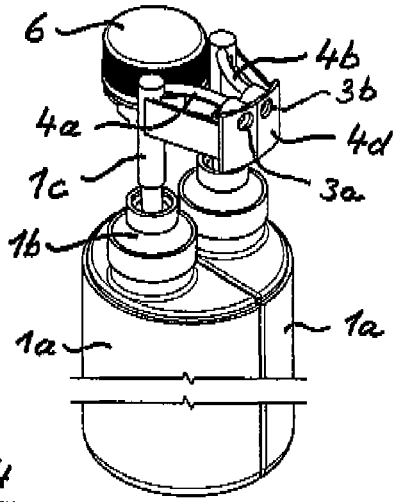
FIG. 4 is a perspective view of the spray dispenser.

FIG. 2 is a side view, being rotated 90° with reference to FIG. 1, wherein further to the push button 7 an inserted adjuster part 6 is visible (cf. FIG. 4). FIG. 3 is a sectional view taken along the section line A-A in FIG. 2. This shows the arrangement of the cartridges 1*a* for the two components and the two pump units 1*b* which are enclosed by the push button 7. This results in a compact design and easy assembly.

Figure 5:
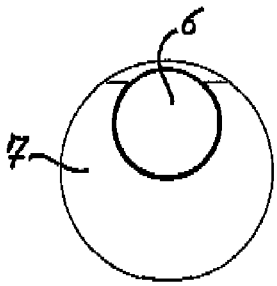
FIG. 5 is a plan view of FIG. 1.

FIG. 4 shows a perspective view, wherein the pushbutton 7 is removed or not mounted. The component out of the front cartridge 1*a* is supplied from the pump unit 1*b* and the pump head 1*c* via the feed or supply channel 4*a* to the outlet opening 3*a*. In an analogue way the second component (here out of the rear cartridge) is conveyed via the supply channel 4*b* to the outlet opening 3*b*, which is arranged together with the other discharge opening at a slide or masking plate 4*d*. The outlet openings 3*a*, 3*b* may also comprise additional spray inserts in order to achieve an intensive mixing of the components by means of superimposed spray cones. This perspective view shows the compact arrangement of the adjuster part 6 between the two pump units 1*b* and the plugged-on pump heads 1*c* as well as the knurling on the periphery of the adjuster part 6. By rotating this adjuster member 6 about the vertical axis, the mixing ratio of the components can be changed, f. i. starting from a 50:50 to a 70:30 mixture ratio. This can be achieved in a simple and ergonomic manner, as the adjuster 6 is inserted into the actuating push button 7 largely aligned or flush, as shown in FIG. 5.

Figure 7:
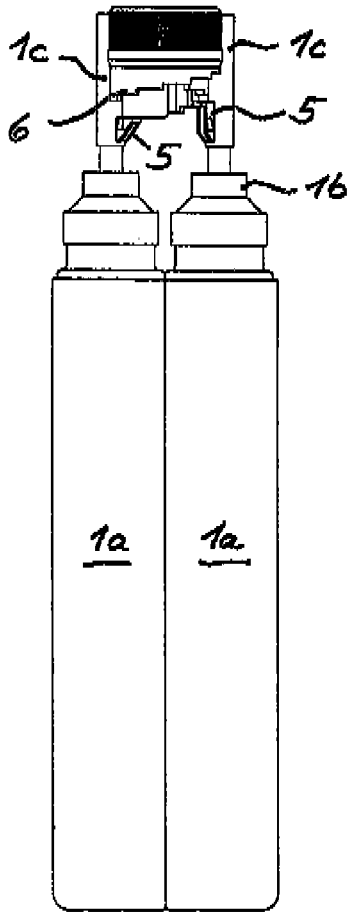
FIG. 7 is a detailed rear view.
Figure 6:
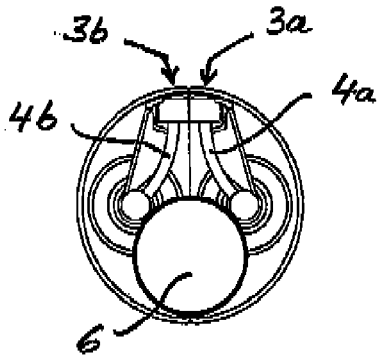
FIG. 6 is another plan view without operating knob.

FIG. 6 shows a plan view, again without the press button 7 in order to illustrate the course of the supply channels 4*a* and 4*b* to the corresponding outlet openings 3*a* and 3*b*. Here again, the compact arrangement of the adjuster part 6 is shown, whereas FIG. 7 (above) is a corresponding rear view in order to explain the function of the adjuster part 6. This element has in the lower region, directed to the pump units 1*b*, stepped extensions which are preferably arranged concentrically, each cooperating with a projection 5 at the pump head 1*c*. Here the left-hand projection 5 is longer in the radial direction and acts together with the internal "stepped ring" while the right projection 5 is shorter and cooperates with the outer "stepped ring" of the adjuster part 6. When these "stepped rings" are rotated around the vertical axis, a time-delayed actuation of the pump units 1*b* results (on or during pressing of the push button 7), and thus a different mixing ratio (except for the central position with simultaneous pumping operation).

FIG. 8 and FIG. 9 illustrate the design of the supply channels 4*a*, 4*b*, wherein FIG. 8 shows the supply channel

4*b* in the production state, while FIG. 9 is the assembly or installation condition thereof. The reference numbers are analogous, and this also applies to the supply channel 4*a*. The outlet opening 3*b* and the projection 5 can be seen in the upper left-hand drawing. At the right hand, rotated 90°, a spring web 4*c* is shown below the supply channel 4*b* (cf. perspective view below) and being integrally formed, in particular by injection molding. The same applies to the masking plate 4*b*, which also has a detent 4*f*, as shown in the left plan view thereof. Thus, on manufacturing the supply channel 4*b* is linear and thus easily demolded and can be bent towards an arched bracket 4*e* to be locked by the detent 4*f* (cf. analogous representation in FIG. 9, bottom left). Thus, the elements of FIG. 8 and FIG. 9 form an integral, inexpensive part, preferably injection-molded, to be easily assembled.

The invention claimed is:

1. An adjustable spray dispenser for plural components with mutually adjacent outlet openings for the components, wherein the outlet openings are provided at a respective supply channel each having a pump unit for each component, wherein a pump head is disposed between the pump unit for each component and the respective supply channel wherein each respective supply channel is straight at manufacturing and is bent along a length thereof on assembly such that the supply channel is in a curved mounting position so as to place the outlet openings close together and oriented in parallel to each other in the spray dispenser, wherein each supply channel has a masking plate having a detent for a locking arrangement with an arched bracket for defining the supply channel in the curved mounting position and wherein each supply channel and adjacent components, namely the masking plate, the detent and the arched bracket are formed as an injection-molded, integral, single-piece part together with the respective pump head.

2. The spray dispenser according to claim 1, wherein each of the supply channels comprises an integrally formed spring web.

3. The spray dispenser according to claim 1, wherein the pump head has a radial projection and wherein the radial projection is opposite to a stepped or coiled adjuster part in a concentric arrangement.

4. The spray dispenser according to claim 3, wherein the adjuster part is located between the pump units and pump heads.

5. The spray dispenser according to claim 3, wherein the adjuster part has a knurling on a periphery and an actuating push-button being essentially flush thereto.

* * * * *